United States Patent [19]

Fraleux et al.

[11] Patent Number: 4,643,689

[45] Date of Patent: Feb. 17, 1987

[54] PICTURE TAKING TUBE WITH PYROELECTRIC TARGET AND A PROCESS FOR DETERMINING THE AXES OF LEAST EXPANSION OF THE TARGET

[75] Inventors: Jean Fraleux; Christine Hennion; Marie H. Mora, all of St. Egreve; Jean L. Ploix, Meylan, all of France

[73] Assignee: Thomson-CSF, Paris, France

[21] Appl. No.: 636,544

[22] Filed: Aug. 1, 1984

[30] Foreign Application Priority Data

Aug. 5, 1983 [FR] France ..... 83 12992

[51] Int. Cl.[4] ..... F23Q 23/08; H01J 31/26

[52] U.S. Cl. ..... 445/3; 313/388; 445/36

[58] Field of Search ..... 313/370, 384, 390, 385, 313/531, 388, 14; 445/3, 36

[56] References Cited

U.S. PATENT DOCUMENTS 3,120,623 2/1964 Cooper ..... 313/390
3,993,907 11/1976 Veron ..... 313/388 X
4,246,510 1/1981 Clark et al. ..... 313/388

FOREIGN PATENT DOCUMENTS 2137164 12/1972 France .
2227627 11/1974 France ..... 313/388

*Primary Examiner*—David K. Moore
*Attorney, Agent, or Firm*—Roland Plottel

[57] ABSTRACT

A picture taking tube with pyroelectric target and a process for determining the axes of least expansion of the target are provided. A connection is formed between the two electrodes of the target and the point of contact of this connection with the electrode deposited on the target is situated in the vicinity of one of the axes of least expansion of the target.

5 Claims, 4 Drawing Figures

PICTURE TAKING TUBE WITH PYROELECTRIC TARGET AND A PROCESS FOR DETERMINING THE AXES OF LEAST EXPANSION OF THE TARGET

BACKGROUND OF THE INVENTION

1. Field of the Invention

The present invention relates to a picture taking tube with pyroelectric target. It also relates to a process for determining the axes of least expansion of the target.

2. Description of the Prior Art

Picture taking tubes with pyroelectric target are well known in the prior art. They are used for taking pictures in thermal television and in particular in the infra red field.

The present invention relates more particularly to the pyroelectric targets.

FIG. 1 is a sectional view showing a pyroelectric target 1 and a circuit which is used in the prior art for supporting this target, biasing it and reading it.

The pyroelectric target 1 is fixed on a thin plate 2 which is itself stretched over a thick ring 3.

This type of support protects the target, which is very fragile, as well as possible from the vibrations to which it may be subjected in the tube in which it is mounted.

An electrode 4, transparent to the radiation to be detected, is deposited on one of the faces of the pyroelectric target.

This electrode 4 is deposited on the face of the target which does not receive the electron beam, symbolized by a straight arrow in the Figure and which serves for reading the charge created on the target by the temperature variation.

An electrode 5 is similarly deposited on the face of the thin plate 2 which does not receive the radiation to be detected. This radiation is symbolized by a wavy arrow in FIG. 1.

Target 1, coated with electrode 4, on the one hand, and ring 3 and the thin plate 2 coated with electrode 5 are assembled together by means of a bonding layer 6.

The read-out signal from the target is collected on electrode 5 which also provides biasing of the target.

There is no connection between the two electrodes 4 and 5 but only a capacitive coupling.

The problem which arises is that the capacity which is seen by the electron beam serving for reading target 1 is formed by the resultant of the capacity of the target and of the bonding layer 6 mounted in series. The signal read by the team is multiplied by the ratio of these capacities $C_{bond}/C_{target}$ and the sensitivity of the target is reduced.

To try to avoid this reduction of sensitivity, the two electrodes 4 and 5 have been connected directly together. Thus, the capacity due to the bonding layer 6 is removed. Moreover, an annular shaped electrode 5 may then be used which further increases the sensitivity, because the radiation to be detected does not have to pass through electrode 5 which is not perfectly transparent.

The applicant has however demonstrated that this solution was not satisfactory for the following reasons. The electrical contact formed between the two electrodes 4 and 5 produces a mechanical disturbance which very often causes breakage of the pyroelectric target during temperature variations. In fact, the thin plate 2 is formed from a resilient material such as a mylar (registered trademark) film; similarly, for layer 6 a bonding agent is chosen having resilient properties so as to allow expansion of the pyroelectric target 1. The introduction into this assembly of an electrical contact, hard from the mechanical point of view, tends to cause the breakage.

The present invention resolves in a simple and efficient way the problem which arises when it is desired to form a direct connection between the electrodes 4 and 5.

SUMMARY OF THE INVENTION

The present invention relates to a picture taking tube, comprising a pyroelectric target, fixed to a thin plate stretched over a thick ring, an electrode being deposited on the pyroelectric target and another electrode of annular shape being deposited on the thin plate, a connection connecting together these two electrodes separated by a bonding layer, wherein the point of contact of this connection with the electrode deposited on the target is situated in the vicinity of one of the axes of least expansion of the target.

A gain of 50% in average sensitivity of the tubes may be obtained with the invention. Thus, with a triglycocoll sulphate target, a sensitivity of 8.5μ A/W was obtained at 25° C. Moreover, what is very important, is that a solid assembly is obtained which does not break.

BRIEF DESCRIPTION OF THE DRAWINGS

Other objects, features and results of the invention will be clear from the following description, given by way of non limitative example and illustrated by the accompanying Figures which show.

In the different Figures, the same references designate the same elements but, for the sake of clarity, the sizes and proportions of different elements are not respected.

DESCRIPTION OF THE PREFERRED EMBODIMENTS

Figure 1:
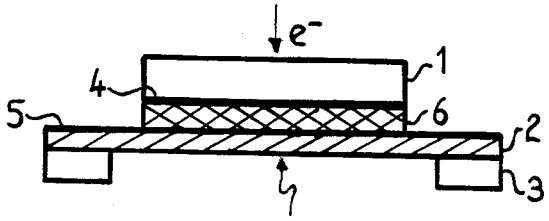
FIG. 1, a sectional view showing a pyroelectric target and the method of mounting used in the prior art.

FIG. 1 was described in the introduction to the description.

Figure 2:
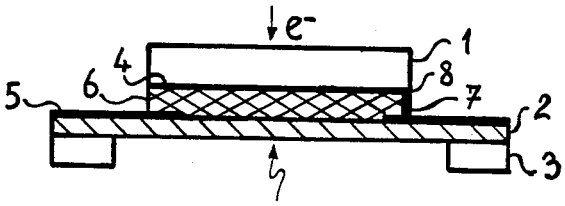
FIGS. 2 and 4, two sectional views showing a pyroelectric target and the method of mounting used in two embodiments of the invention.
Figure 3:
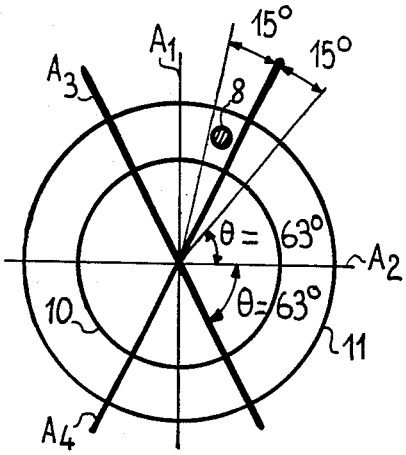
FIG. 3, a top view of FIG. 2.

In FIGS. 2 and 3, a target is shown assembled according to one embodiment of the invention, seen in section in FIG. 2 and seen in a top view in FIG. 3.

According to the invention, the point of contact with electrode 4, deposited on the target, of the connection between the two electrodes 4 and 5 is positioned in the vicinity of one of the axes of least expansion of the target.

As is known a pyroelectric target is formed from a monocrystalline plate from an insulating material having spontaneous electric biasing which depends on its temperature.

Generally triglycocoll sulphate, designated by the letters TGS, is generally used or its fluorinated or deuterated derivatives, such for example as triglycocoll fluoroberyllate or TGFB or DTGS, or DTGFB.

The pyroelectric plate is generally cut perpendicular to the pyroelectric axis. It may also be oblique with respect to this axis.

The substances used for forming the pyroelectric target are very anisotropic and have two perpendicular axes of high expansion, corresponding to expansions in opposite directions. Between these two axes there exist two other axes corresponding to a zero expansion.

According to the invention, the point of contact of the connection between the two electrodes 4 and 5 with electrode 4, deposited on the target, is disposed in the vicinity of one of the axes of least expansion.

Thus, there will be no breakage of the pyroelectric target.

FIG. 2 differs from FIG. 1 because electrode 5 is annular in shape and connection 7 is provided between the two electrodes 4 and 5.

In the embodiment shown in FIG. 2, connection 7 is formed by including a conduction material in the bonding layer 6. This material may for example be metal lacquer, graphite or a conducting bonding agent. The introduction of a hard product in the bonding agent could cause breakage of the connection if the precaution is not taken of positioning the point of contact 8 of connection 7 with electrode 4 in the vicinity of one of the axes of least expansion of the target.

In FIG. 2, connection 7 is vertical.

In FIG. 3, there is partially shown the target of FIG. 2 and the assembly thereof, seen from above. The two circles 10 and 11 correspond to the internal diameter of electrode 5 and to the internal diameter of ring 3.

The two high expansion axes $A_1$ and $A_2$ of the target have been shown, which are perpendicular to each other, as well as the axes of least expansion of the target $A_3$ and $A_4$.

In FIG. 3, by way of example, the point of contact 8 is placed close to axis $A_4$.

In fact, it is thought satisfactory to place the contact point 8, and generally also the whole connection 7, in an interval of about 30° centered on one of the axes of least expansion of the target.

It is advantageous to place the contact point 8 as close as possible to the periphery of the electrodes 4 and 5 so that it does not disturb the useful zone of the target.

The axes of least expansion may be determined by using X rays, from the determination of the crystalline axes.

The axes of least expansion may also be determined by locating the crystalline axes during growth of the pyroelectric target.

The invention also provides a process for determining these axes.

In the following description, the process of the invention will be described in the case of a pyroelectric target formed from a thin plate of TGS cut perpendicularly to the pyroelectric axis.

This target is placed under a hot source. An incandescent lamp may for example be used. The target is brought for example to a temperature of 40° or 50° C.

Under the action of the heat, the target swells out along an axis, for example axis $A_1$ and becomes for example concave. Thus one of the axes of high expansion has been determined.

If the heating is further continued for a few minutes, for example, the target swells out in the opposite direction and along an axis perpendicular to the first one. For example, it becomes convex along axis $A_2$.

By calculations well known to a man skilled in the art, the angle $\theta$ between the axis of high positive expansion and the two axes of least expansion $A_3$ and $A_4$ may be determined. This angle depends particularly on the material used for the target.

In FIG. 3, axis $A_2$ is the axis of high positive expansion and there is an angle $\theta$ of 63° between axis $A_2$ and the two axes $A_3$ and $A_4$. These two axes are symmetrical with respect to axes $A_2$.

To determine which of the axes of high expansion is the axis of positive expansion, the crystalline axes of the target are used. These crystalline axes may for example be indicated by the manufacturer of the targets.

The accuracy in determining axes $A_3$ and $A_4$ is sufficient for the desired use.

It is of course sufficient to determine one of the axes $A_1$ and $A_2$ in order to obtain the axes $A_3$ and $A_4$.

Determination of the axes $A_3$ and $A_4$ may be used other than for positioning connection 7.

To sum up, the process for determining the axes of least expansion is the following:

1. The target is placed under a hot source;
2. At least one of the mutually perpendicular axes is identified along which it deforms successively and which form its axes of high expansion $A_1$, $A_2$;
3. The angle $\theta$ is calculated between the axis of high positive expansion $A_2$, which is determined from its crystalline axes and each of the axes of least expansion $A_3$, $A_4$.

Figure 4:
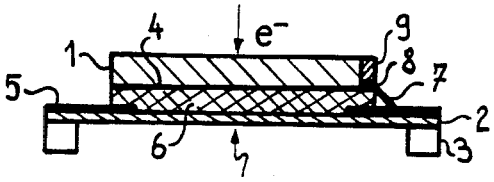

In FIG. 4 is shown a sectional view of another embodiment of the invention.

In this embodiment, connection 7 is external. An orifice 9 is formed in the target for connecting connection 7 to electrode 4. Electrode 5, as can be seen in the Figures, is readily accessible because of its large diameter. Orifice 9 must be formed without damaging electrode 4 because contact must be made again at this position.

Etching may be provided by local dissolution of the crystal of the target, or also for example by ionic or plasma etching with masking.

Connection 7 may be, as in the case of FIG. 2, formed from metal lacquer or a conducting paste.

What is claimed is:

1. A process for determining the axes of least expansion of a pyroelectric target for a picture taking tube, comprising the following steps:

placing the target under a hot source;

identifying at least one of the mutually perpendicular axes along which it deforms successively and which form its axes of high expansion.

determining the angle between the axis of high positive expansion, which is determined from its crystalline axes, and each of the axes of least expansion.

2. A process according to claim 1, comprising the following steps:

depositing an electrode (4) on the pyroelectric target (1);

stretching a thin plate (2) across a thick ring (3) and depositing another electrode (5), annular in shape, on the thin plate (2);

assembling by means of a bonding layer (6) the target (1) coated with the electrode (4) and the thin plate (2), coated with the electrode (5);

connecting together the two electrodes (4, 5) by a connection (7) the point of contact (8) of this connection with the electrode (4) deposited on the target (1) being situated in the vicinity of one of the axes of least expansion of the target.

3. A process according to claim 2, wherein said point of contact (8) of the connection (7) is situated substantially in an interval of about 30° centered on one of the axes of least expansion of the target.

4. A process according to claim 2, wherein said bonding layer (6) comprises a conducting material which is constituting said connection (7).

5. A process according to claim 2, wherein said connection (7) is external to the bonding layer (6) and an orifice is provided in the target (1), to realize the connection with the electrode (4) covering the pyroelectric target.

* * * * *